United States Patent [19]

Van Den Kieboom

[11] Patent Number: 4,662,107

[45] Date of Patent: May 5, 1987

[54] COMBINATION FLOWER AND DISPLAY CONTAINER

[76] Inventor: Jan M. Van Den Kieboom, 9023 Glenwood Dr., Greendale, Wis. 53129

[21] Appl. No.: 814,809

[22] Filed: Dec. 30, 1985

[51] Int. Cl.[4] ..... A01G 9/02

[52] U.S. Cl. ..... 47/84; 47/72

[58] Field of Search ..... 47/84, 41.11, 41.12, 47/41.13, 72; 106/287.13; 556/465

[56] References Cited

U.S. PATENT DOCUMENTS

| | | | |
|---|---|---|---|
| 1,828,295 | 10/1931 | Roy | 47/41.11 |
| 2,150,453 | 3/1939 | Mulford et al. | 47/84 |
| 2,355,559 | 8/1944 | Renner | 47/72 |
| 2,736,138 | 2/1956 | Buttery | 47/84 |
| 2,900,760 | 8/1959 | Tupper | 47/41.11 |
| 3,754,642 | 8/1973 | Stidolph | 47/84 |
| 4,118,890 | 10/1978 | Shore | 47/84 |
| 4,154,617 | 5/1979 | Keithler | 106/287.13 |
| 4,170,301 | 10/1979 | Jones et al. | 47/84 |

*Primary Examiner*—Robert A. Hafer
*Assistant Examiner*—Bradley M. Lewis
*Attorney, Agent, or Firm*—Andrus, Sceales, Starke & Sawall

[57] ABSTRACT

A combination flower and display container includes an open top housing, an open top vase slidably received within the housing, a display such as a greeting card or photograph positioned between the vase and a side wall of the housing, and a cover for the housing having an aperture therein through which flowers extend. The housing is composed of a transparent material so that the display is prominently displayed. The vase includes a water impervious member covering its open top having a plurality of holes formed therein for receiving the stems of flowers. A sealant may be utilized around the holes to provide a waterproof unit so that leakage of water and/or spilling is prevented when the container is inadvertently dropped or tipped over. The container is also uniquely held inside of a carton for ease of shipping and handling.

10 Claims, 5 Drawing Figures

COMBINATION FLOWER AND DISPLAY CONTAINER

BACKGROUND OF THE INVENTION

The present invention relates to flower holders, and more particularly to a flower holder for the handling, transportation and display of artificial and/or fresh cutflowers, plants and plant arrangements.

Florists have traditionally provided only minimal protection for cutflower arrangements during delivery. Typically these measures include wrapping or covering the cutflowers with sheet material, inserting the stems of the flowers in a container having moisture saturated material therein, and then placing the flowers and container within a cardboard box which in turn is wrapped with a ribbon material. Alternately, open flower vases or other containers are employed. Frequently, however, the blossoms of flowers so transported are left exposed to the elements during delivery resulting in flower petals becoming unnecessarily bruised and damaged. Additionally, such flower arrangements cannot be mailed to distant persons. Furthermore, after delivery the recipient must locate a suitable vase or other flower holder which may not be readily available.

Various types of flower enclosures utilized for the shipment, storage and display of plants, cutflowers and the like are known. See for example U.S. Pat. Nos. 265,836; 1,572,444; 2,160,998; 2,664,670; 3,734,275; 3,973,356; 4,113,094; 4,242,835; and 4,418,497. There remains a need, however, to provide an improved container for flowers.

SUMMARY OF THE INVENTION

A combination flower and display container includes an open top housing defining a vase-receiving opening, an open top vase for holding flowers slidably received within the opening in the housing, and a panel member positioned between the vase and housing to display indicia thereon. A cover for the housing having apertures therein through which the flowers extend may also be utilized. The container is also uniquely held inside of a carton for ease of shipping and handling.

The vase may include a water impervious member covering its open top which is sealed on the vase by means of a lid threaded or otherwise fitted thereon. The member includes a plurality of puncturable slits therein forming holes for receiving the stems of flowers such that leakage of water is kept to a minimum. Also, a sealant may be utilized for sealing the holes and stems to provide a waterproof container which prevents the leakage of water from the vase.

It is a general object of the invention to provide an improved device for handling, transporting and displaying flowers.

Another object of the invention is to provide a shipping and display container for cutflowers which is delivered in a waterproof condition that prevents leakage of water from the vase.

Another object of the invention is to provide a container for fresh cutflowers which may be delivered in a maintenance-free condition.

It is another object of the invention to provide a flower container containing artificial and/or fresh cutflowers, plants or plant arrangements that may be mailed to its recipient.

It is the further object of the invention to provide an attractive flower container for showing greeting cards, advertisements, photographs or other display material.

It is still another object of the invention to provide a disposible vase for fresh cutflowers which is placed inside an outer display housing for combining the attractiveness of fresh cutflowers with ornamentation provided by greeting cards, photographs, advertisings or other display material.

Yet another object of the invention is to provide an inexpensive container for flowers which is disposable while the display housing remains in a condition to be refilled with a new supply of flowers or plants.

An additional object of the invention is to provide a container both esthetically pleasing and one which provides a sturdy display support.

Florists typically sell fresh cutflowers in bunches or in flower arrangements. The present invention places the fresh cutflowers in a disposable sealed container which is placed inside a display container which features an advertising means, greeting cards or photographs. Also flower arrangements or pot plants can be placed inside the display container.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
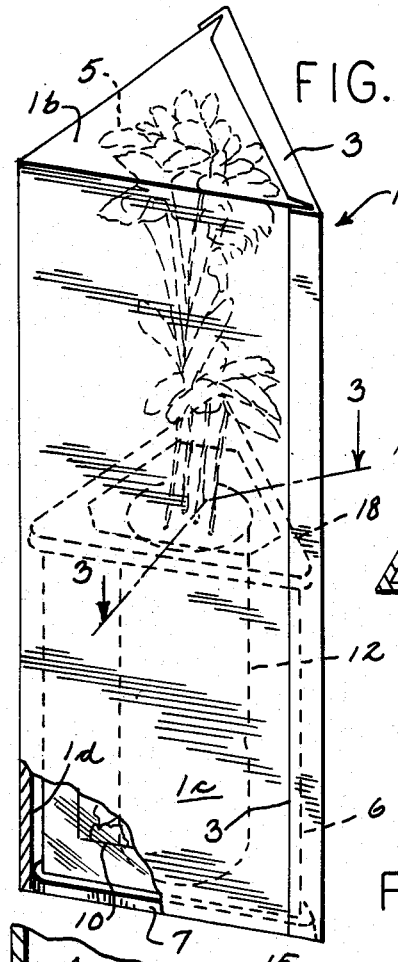
FIG. 1 is a perspective view illustrating a combination flower and display container constructed in accordance with the present invention within a shipping container.
Figure 3:
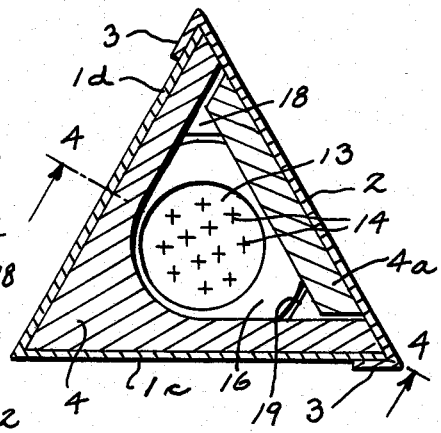
FIG. 3 is a cross sectional view taken along the plane of the line 3—3 in FIG. 1.
Figure 4:
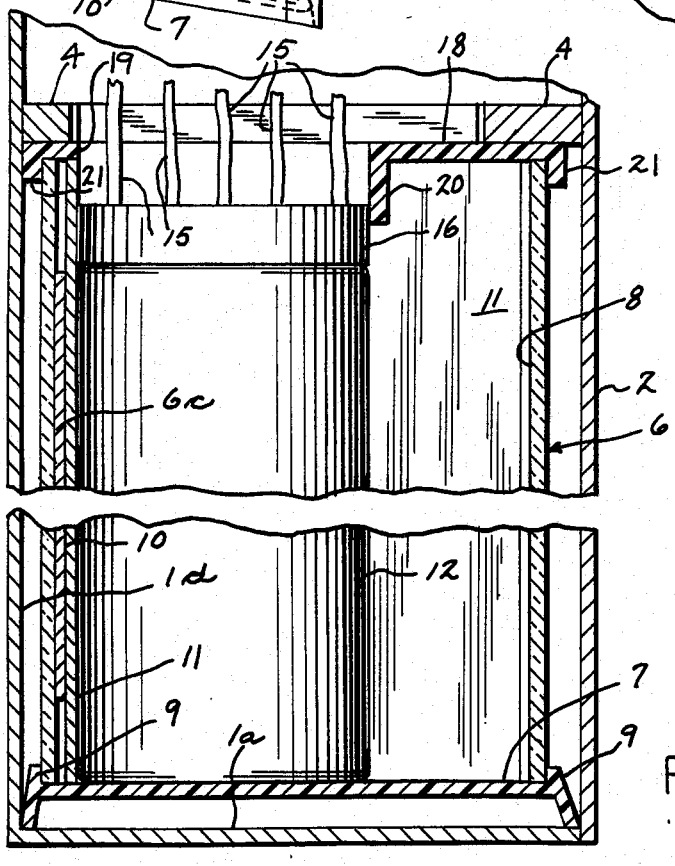
FIG. 4 is a fragmentary cross sectional view with parts broken away taken along the plane of the line 4—4 in FIG. 3.
Figure 2:
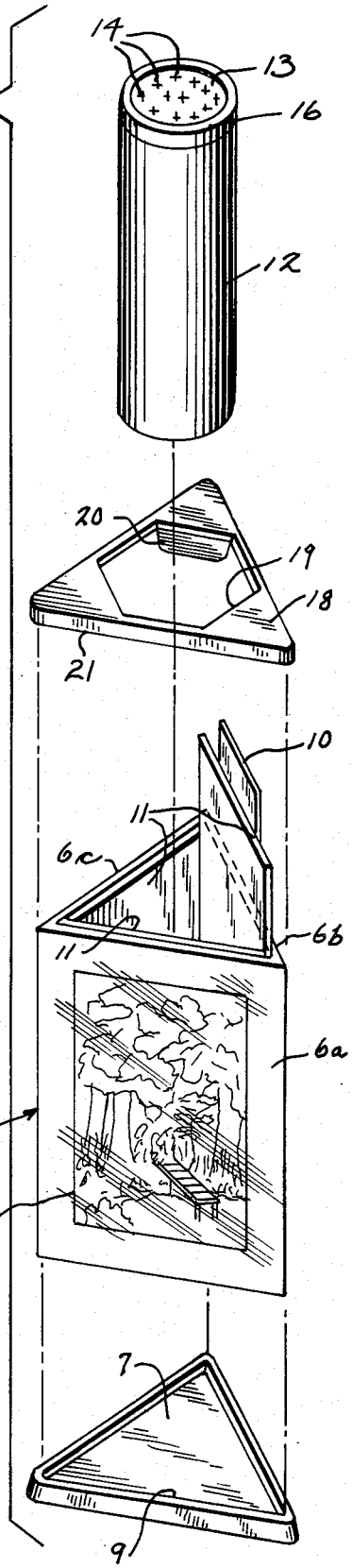
FIG. 2 is an exploded view of the flower and display container illustrating the components thereof.

Referring now to the drawings, FIG. 2 illustrates a combination flower and display container constructed in accordance with the principles of the present invention. FIGS. 1, 3 and 4 in turn illustrate the container within a shipping carton generally designated by the numeral 1. As illustrated, carton 1 is triangular in shape to match the shape of the container although any other configuration may be utilized. Carton 1 may be comprised of a cardboard material having a V-shaped shell portion with an open front, and a panel member for enclosing the open front of the shell portion. The shell portion includes a closed bottom 1*a*, a closed top 1*b*, and a pair of side walls 1*c* and 1*d*. The panel member includes a third wall 2 which has foldable lips 3 along each of its edges. The lips 3 include adhesive thereon for attaching the panel member to the shell portion so that the panel member may be utilized to enclose the container within carton 1 for shipping and/or handling purposes. Carton 1 also includes a U-shaped divider 4 on walls 1*c* and 1*d*, and a mating divider 4*a* on the inside of wall 2 to hold the container inside carton 1 against bottom wall 1*a* to prevent the container from sliding within carton 1. Dividers 4 and 4*a* thus prevent flowers 5 from being crushed or damaged should carton 1 be inadvertantly placed upside down.

While FIG. 1 illustrates the container of the present invention with fresh cutflowers 5, it is clear that the container may also be utilized with artificial flowers, as well as other types of plants and plant arrangements. The term "flower" as used herein is thus intended to include flowers, plants and plant arrangements whether live and growing, freshly cut or artificial.

Referring now to FIG. 2, the combination flower and display container includes a triangular shaped housing 6 having a closed bottom wall or base 7 and three upright side walls 6*a*, 6*b* and 6*c* extending from bottom wall 7 defining a vase receiving opening 8 within housing 6. Although shown as triangular, housing 6 may take any other conventional shape such as hexagonal, circular, etc. Housing 6 is preferably composed of a transparent plastic material such as an acrylic available under the trade designation Plexiglas. Bottom wall 7 includes a lip 9 around it periphery which is dimensioned to snuggly receive the bottom edges of the side walls of housing 6.

Display means with indicia thereon is positioned within opening 8 of housing 6 along the inside surface of each side wall of the housing 6. As shown best in FIGS. 2 and 4, this display means comprises a photograph 10 in abutting relationship with the side wall of housing 6 together with a backing member or matte 11 which functions as a border or frame around photograph 10. Matte 11 is dimensioned to substantially correspond to the dimensions of a side wall 6*a*–6*c* of housing 6 so as to completely frame photograph 10. Although illustrated as a photograph 10 and matte 11, the display means may also comprise a greeting card, advertisement or other display depending upon the desired end use.

The display means is positioned between each side wall 6*a*–6*c* of housing 6 and an open top vase or pot 12 slidably received within opening 8 of housing 6. Vase or pot 12 is composed of any conventional plastic material and is designed to be a throw away or disposable item. Vase or pot 12 is dimensioned so that when received within opening 8 of housing 6 vase 12 engages each of the three mattes 11 so as to hold mattes 11 and photographs 10 in an upright position against the inner surface of the side walls of housing 6.

Figure 5:
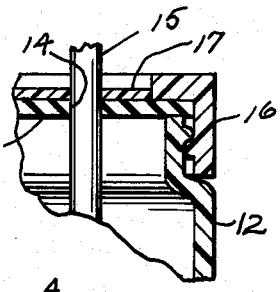
FIG. 5 is a fragmentary detailed view in cross section illustrating the sealing arrangement for the vase and the flower stems.

Vase or pot 12 may also include a water impervious member 13, preferably composed of rubber, covering its open top. As shown best in FIGS. 4 and 5, member 13 includes a plurality of puncturable slits therein forming holes 14 for receiving stems 15 of cutflowers 5. Holes 14 have a diameter substantially corresponding to the diameter of stems 15 so that a snug fit is provided. Member 13 is secured on the upper lip of vase 12 by means of a cap 16 threaded thereon, as shown best in FIG. 5. Cap 16 includes a central opening 17 in its top which enables stems 15 to be inserted within vase or pot 12 through holes 14. In order to seal stems 15 in holes 14 to insure that vase 12 is waterproof, a layer of sealant 17 such as silicone may be applied on the top surface of member 13 after stems 15 are inserted therethrough. Thus, vase 12 is completely waterproof with the result that no water spillage occurs during transportation or use when dropped or tipped over.

The container may also include a cover 18 for housing 6. Cover 18 includes a hexagonal shaped aperture 19 formed therethrough through which vase 12 may be inserted. Cover 18 includes at least one tab 20 extending downwardly into opening 8 of housing 6 which is engageable with the display means to aid in holding the display means in an upright position. Cover 18 is triangular in shape to match the shape of housing 6 and includes a downwardly extending lip 21 dimensioned to snuggly receive the upper edges of the side walls 6*a*–6*c* of housing 6. Although illustrated as being separate from vase or pot 12, cover 18 may also be integral with vase or pot 12 to form a one-piece vase and cover.

A combination flower and display container has been illustrated and described. The container provides a holder for artificial and/or fresh cutflowers, plants and plant arrangements which includes a disposable, maintenance free, waterproof vase for the flowers or plants placed within an outer display housing that provides for showing greeting cards, advertisements, photographs or other display material.

Various modes of carrying out the invention are contemplated as being within the scope of the following claims particularly pointing out and distinctly claiming the subject matter which is regarded as the invention.

I claim:

1. A combination flower and display container, comprising:

an open top housing having a closed bottom wall and a plurality of adjacent upright side walls extending from said bottom wall defining a vase-receiving opening within said housing;

an open top vase for holding flowers slidably received within said housing in said opening;

display means having indicia thereon removably positioned between said vase and each of the side walls of said housing, said display means supported by both said vase and corresponding ones of said side walls whereby said display means is held in a position to display the indicia thereon;

a cover for said housing having an aperture therein through which the flowers extend, said cover includes at least one tab extending into the opening in said housing, said tab having opposite edges and a surface facing said aperture, said tab extending between adjacent housing side walls so that said opposite edges are engageable with adjacent display means to aid in holding said display means in an upright position, and said surface is engageable with said vase to aid in holding said vase in an upright position.

2. The container of claim 1, wherein said housing is composed of a transparent material.

3. The container of claim 1, wherein said vase includes a water impervious member covering the open top of said vase, and means for securing said member on said vase in sealing relationship therewith.

4. The container of claim 3, wherein said securing means includes a cap member threadedly engaged with said vase that traps said impervious member between said cap and vase to provide said sealing realtionship.

5. The container of claim 3, wherein said impervious member includes a plurality of puncturable holes for receiving flower stems, said holes having a diameter substantially corresponding with the diameter of the cutflower stems.

6. The container of claim 5, further including sealing means for sealing said holes and stems in waterproof relationship.

7. The container of claim 6, wherein, said sealing means comprises a silicone sealant.

8. The container of claim 1, wherein said display means is a photograph.

9. The container of claim 5, wherein said holes comprise puncturable slits formed in said member.

10. The container of claim 1, wherein said housing includes three side walls and is triangular in cross section.

* * * * *